US005368305A

United States Patent [19]

Rodda et al.

[11] Patent Number: 5,368,305

[45] Date of Patent: Nov. 29, 1994

[54] BLACK-JACK TYPE WAGERING GAME METHOD

[76] Inventors: Joseph Rodda; Misty Rodda, both of 3342 S. Sandhill Rd. #9-522, Las Vegas, Nev. 89121

[21] Appl. No.: 95,703

[22] Filed: Jul. 22, 1993

[51] Int. Cl.[5] ..... A63F 1/00

[52] U.S. Cl. ..... 273/292; 273/274

[58] Field of Search ..... 273/274, 292, 309

[56] References Cited

U.S. PATENT DOCUMENTS

| | | | |
|---|---|---|---|
| 4,659,087 | 4/1987 | Shen et al. . | |
| 5,013,049 | 5/1991 | Tomaszewski . | |
| 5,098,107 | 3/1992 | Boylan et al. . | |
| 5,154,429 | 10/1992 | LeVasseur . | |
| 5,288,081 | 2/1994 | Breeding | 273/292 |

OTHER PUBLICATIONS

Scarne, John–"Scarne's Complete Guide To Gambling," 1961, pp. 314–325, 348–352.

Gibson, Walter, "Hoyle's Modern Encyclopedia of Card Games", 1974, pp. 303, 304.

*Primary Examiner*—Vincent Millin

*Assistant Examiner*—William M. Pierce

*Attorney, Agent, or Firm*—Richard C. Litman

[57] ABSTRACT

A card game utilizes one or more modified decks of standard playing cards by eliminating the eights, nines and tens. The remaining spot cards (ace through seven) are valued at face value, while the face or court cards (kings, queens and jacks) are valued at one half point each. The object of the game is to draw a hand totaling seven and one half points, without exceeding that total. Various options are provided, including "splitting pairs," in which two equal value cards may be split into two hands at the beginning of play where the point values for the first card and the subsequent card are each less than four; "doubling down," in which a player may double the wager and receive one further card: or "surrendering," where a player may give up a portion of the wager at the beginning of play. Wagers are returned to the player in the case of ties, rather than going to the dealer. The game is adaptable to casino play, electronic or computer play, and also to private play by individuals. A playing surface adapted specifically for the play of the present game is also provided.

9 Claims, 2 Drawing Sheets

BLACK-JACK TYPE WAGERING GAME METHOD

FIELD OF THE INVENTION

The present invention relates generally to card games and particularly those involving betting or wagering, and more specifically to a card game utilizing only a limited number cards from a standard 52 card deck(s) wherein players attempt to approach a predetermined limit without exceeding the limit, drawing cards or accepting cards from a dealer. The game is adaptable to standard manual playing techniques, and/or electronic or computer play with the adaptation of the proper algorithms and/or programs.

BACKGROUND OF THE INVENTION

Risk taking and gambling has always been a part of human nature, and accordingly a multitude of games of chance have been developed to meet this need. Many such games involve playing cards, but most such card games involve play against player, and one player's fortune is to at least some extent dependent upon the skill (or lack thereof) of the other player(s).

Many card players and gamblers have found that a game which involves attempting to approach a predetermined numerical limit with the values represented by the cards drawn to be particularly exciting, due to the element of suspense throughout the play of the hand; it is possible in such a game to closely approach or exactly meet the limit, or go "bust" and exceed the limit, all the way through the play of the last card of the hand. Other types of card games generally fail to provide such excitement, as the probability of holding either a winning or losing hand is generally evident after the draw of a relatively few cards.

Some games, such as Twenty-One or Blackjack, have been developed which eliminate the human element of other players at least to some degree and also provide play approaching a limit as discussed above, but the rules for such games are accordingly relatively limited and play of the game may not provide a sufficient number of variables to hold the interest of many players, particularly those more sophisticated in such games.

The need arises for a card game utilizing one or more modified decks of standard playing cards, in which player(s) attempt to approach and meet a predetermined limit without exceeding the limit. The game should provide sufficient variables so as to maintain the level of interest of the players, and yet reduce or eliminate the element of skill of opposing players which often proves daunting to less experienced players of gambling card games.

DESCRIPTION OF THE PRIOR ART

U.S. Pat. No. 4,659,087 issued to Margaret Shen et al. on Apr. 21, 1987 discloses a Casino Game involving the play of two groups of two cards each with the object being for each of a player's pairs to have a higher value than the two pairs of the dealer. The layout of the playing surface is roughly semicircular, as in the present game, but no predetermined limit is involved, nor is the standard deck modified in any way for use in the game.

U.S. Pat. No. 5,013,049 issued to Joseph Tomaszewski on May 7, 1991 discloses a Card Game using a semicircular playing surface and allowing the use of discards in the play of a game resembling the game of Twenty One or Blackjack. Provision is made for the breaking of ties, unlike the present game, but no provision is made for other playing or betting options (other than additional payment for hitting the limit exactly), as in the case of the present game.

U.S. Pat. No. 5,098,107 issued to Eugene B. Boylan et al. on Mar. 24, 1992 discloses a Method And Apparatus For Playing A Wagering Game. Wagers may be placed upon the outcome of card play according to the rules of various known games (including Twenty One or Blackjack), but the game includes an additional wager based upon the exposure of additional cards. This is the only option provided; no other options for doubling one's bet or other variations are provided, as in the case of the present game.

U.S. Pat. No. 5,154,429 issued to Richard A. LaVasseur on Oct. 13, 1992 discloses a Method Of Playing Multiple Action Blackjack and discloses a semicircular playing surface with the rules of play being similar to Twenty One or Blackjack. However, the dealer is allowed to play two consecutive hands and players have the opportunity to win or lose twice with each player's hand.

Finally, Scarne's Complete Guide To Gambling by John Scarne and published by Simon and Schuster, New York, in 1991, provides discussion of the history of the game of Seven and a Half on pages 314 and 315 of the publication. However, the version discussed is thought by Scarne to be a forerunner of the game of Twenty One or Blackjack, and includes variations (such as a wild card) not present in the present game. Moreover, the present game provides for other options not disclosed in the Sterne publication.

None of the above noted patents, taken either singly or in combination, are seen to disclose the specific arrangement of concepts disclosed by the present invention.

SUMMARY OF THE INVENTION

By the present invention, an improved card game is disclosed.

Accordingly, one of the objects of the present invention is to provide an improved card game which includes a predetermined limit, with players drawing or accepting cards having predetermined values and attempting to approach or match the limit without exceeding it.

Another of the objects of the present invention is to provide an improved game which uses one or more standard decks of playing cards, modified to remove the eights, nines and tens from the deck(s).

Yet another of the objects of the present invention is to invention is to provide an improved card game in which at least some of the cards are valued at one half point each, while others are valued at face value, in the determination of the total value of a hand.

Still another of the objects of the present invention is to provide an improved card game which can be used as a casino betting game, as well as a privately played game among two or more individuals.

A further object of the present invention is to provide an improved card game which allows various options to be used, such splitting pairs, doubling bets, and surrendering a portion of a bet early in the play of a hand.

An additional object of the present invention is to provide an improved card game in which bets involving ties are returned to the bettor or player, rather than going to the dealer or house.

A final object of the present invention is to provide an improved card game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the attached drawing figure.

DETAILED DESCRIPTION OF THE PREFERRED EMBODIMENTS

Figure 1:
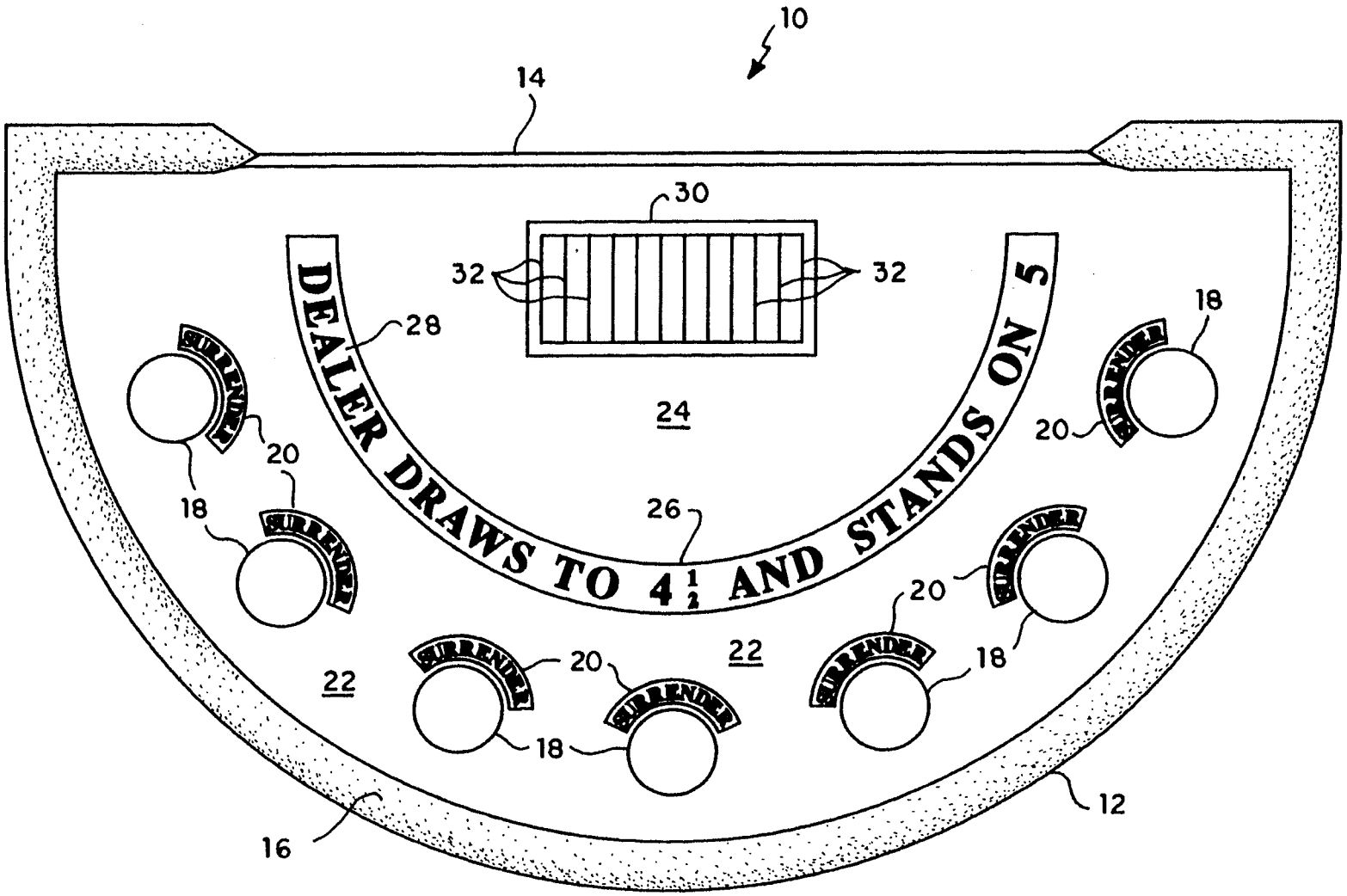
FIG. 1 is plan view of a playing surface provided for the play of the present game.

Referring now to the drawing, the present invention will be seen to relate to a card game and table or playing surface 10 therefor, wherein two or more players alternatingly draw or are dealt cards and attempt to approach or meet a predetermined total value of seven and one half without exceeding that value. The cards are of one or more standard 52 card decks (e.g., bridge or poker decks), with the eights, nines and tens of each suit (and wild cards or jokers, if any) removed from the deck(s). Thus, the modified deck(s) used in the play of the present game will contain the cards shown in the following table:

| GAME CARDS | | | |
|---|---|---|---|
| Spades | Hearts | Diamonds | Clubs |
| ace | ace | ace | ace |
| two | two | two | two |
| three | three | three | three |
| four | four | four | four |
| five | five | five | five |
| six | six | six | six |
| seven | seven | seven | seven |
| jack | jack | jack | jack |
| queen | queen | queen | qeen |
| king | king | king | king |

As can be seen, the present game uses a total of 40 cards per deck, ten in each of the four standard suits, although there is no distinction between any of the suits. Each of the "spot" cards (ace through seven of each suit) has a point value equal to its number, with the ace therefore having a value of one point; unlike the game of Twenty One or Blackjack, the aces do not have variable values depending upon the need of the player for a given hand. Each of the "face" or "court" cards (jack, queen and king of each suit) is given a value of one half point. These are the only cards used in the play of the present game, although it will be understood that more than one deck containing the above cards may be used, depending upon the number of players, the policies and rules of the casino playing the game, etc. No jokers or wild cards are used; each card has only a single, specific point value as described above.

The object of the present game is to acquire cards (i.e., to draw or be dealt cards) approaching a total value of seven and one half points for each round or hand, without exceeding the seven and one half point limit. The player (or dealer) who comes closest to or exactly equals the 7½ point limit without exceeding the limit, is the winner of the round or hand. Any player (or dealer) who exceeds the 7½ point limit, loses the hand.

Figure 2:
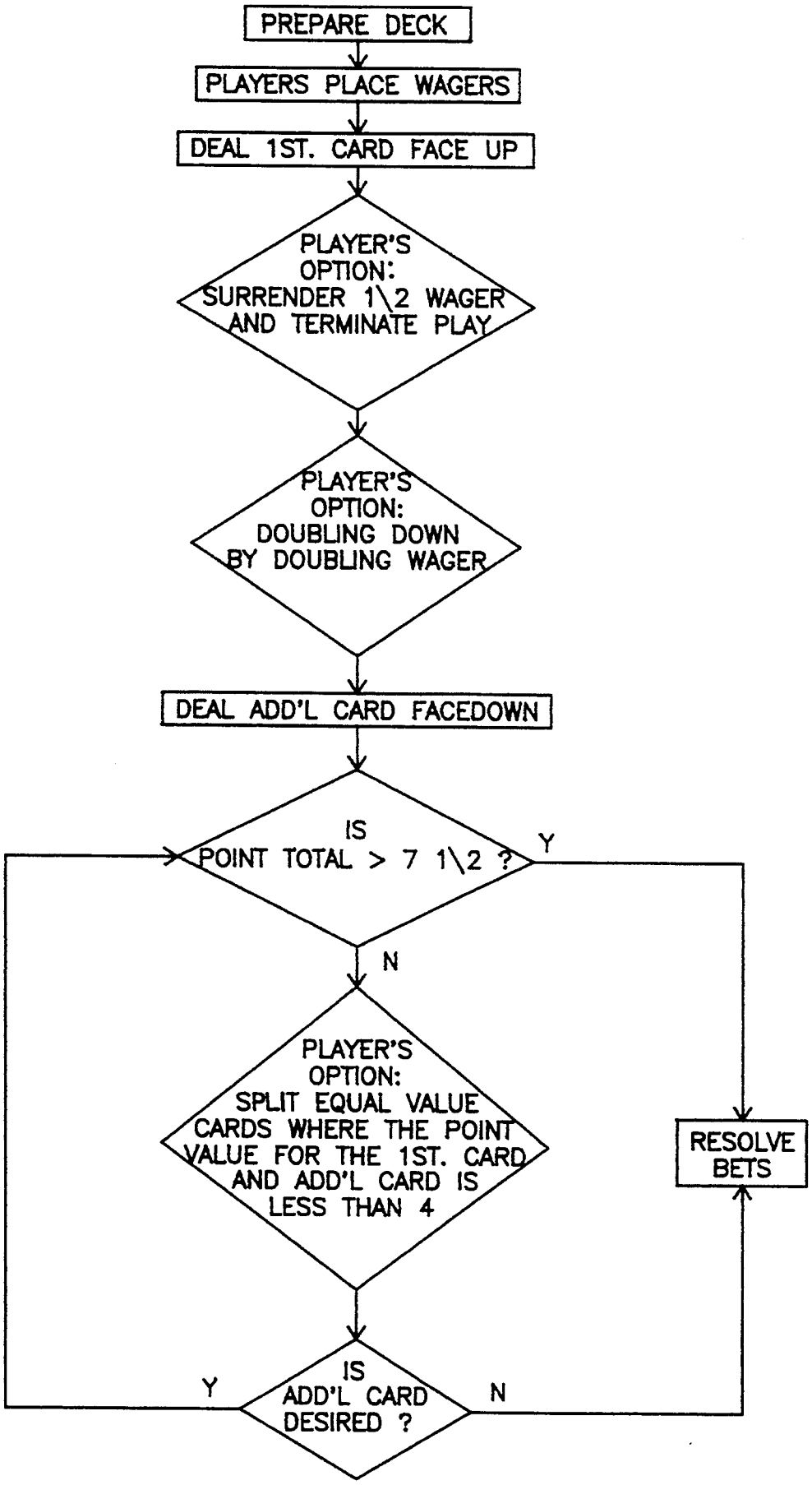
FIG. 2 is a flow chart describing the method of play for the present game.

The method of play is shown in the flow chart of FIG. 2, and will be described in greater detail below. The player(s) and the dealer are each initially dealt a single card, face up, and are thus aware of the value of one another's card. At that point, each player in turn may choose to acquire another card (face down so neither the dealer nor other players, if any may see its value) or to "stand," i.e., not accept any further cards. Assuming the player chooses to acquire a second card, and the total value of the first and second cards do not exceed 7½ points, the player may choose to acquire a third card, and so on. However, the moment that the player's card value total exceeds 7½ points, that player is out of the game for that hand and loses any wager he/she has placed on that hand. The same rules also apply to the dealer. However, in the event that the present game is played as a casino game having a permanent dealer playing for the "house" or gambling establishment, additional rules limiting the dealer's choice in the acquisition of further cards or "standing" on the point value of card(s) already received, may be instituted, and the dealer does not complete the play of his/her hand until each player has completed the play of his/her hand. In such a casino game, the dealer may be required to draw a further card(s) if his/her point total is 4½ or less, and required to stand if he/she has five points or more. (The dealer is "bust" or loses in the event he/she exceeds 7½ points, just as in the case of other players.) An example of a typical hand of the present game is described below.

Let us assume a game with three persons playing, one of whom is acting as a dealer according to the above described dealer rules. The dealer and the two other players are each dealt a single card face down. For the sake of the present example, let us assume that the dealer draws a three, with the first player drawing a five and the second player drawing a king. (As noted above, the specific suits, i.e., spades, hearts, diamonds, and clubs, are meaningless with respect to the present game.) Thus, the values of the cards held by the dealer and first and second players are respectively three points, five points, and one half point.

The first player, having only three points, may choose to accept another card; this second card is dealt face down, so only the first player is aware of its value. Let us assume it is a queen having a value of one half point, thus giving the first player a total of 3½ points with his/her two cards. The second player, having five points with the first card, may choose to "stand" and hope that the five points of his/her single card are higher than the dealer's or other player's total, or may choose to acquire a second card in an attempt to approach the 7½ point total. In the event the second player accepts a second card having a value of four, the second player's total for his/her two cards will be seen to be nine (5+4), and thus has gone "bust," or exceeded the maximum allowable total of 7½ points and thereby lost any wager placed by that player for the hand examplified. The dealer, while being required to draw or stand according to the rules described above, does not play until all other players have completed their play by "standing" on whatever total of less than 7½ points he/she has received, or continuing to play by acquiring an additional card or cards.

Let us assume that the first player, having a total of 3½ points with his/her first two cards, chooses to acquire a third card, which third card has a value of three, for a total of 6½ points. This player may wish to "stand" on this total, thus requiring the dealer to complete the play of the dealer's hand.

According to the above rules, the dealer must now accept cards (face up, so the first player still in the game can see their values) until he/she acquires a total card point value of at least 4½ points. Assuming the dealer draws a face card (e.g., a jack) having a value of ½ point, the dealer must continue to draw another card, as the total value of the first and second cards to the dealer is only 3½ points. Assuming the dealer's third card drawn is a two, the dealer will then have a total card point value of 5½ points, or one point less than the "standing" first player with his/her accumulated total of 6½ points from the three cards drawn by that player. However, according to the rules, the dealer is prohibited from drawing further cards once his/her total equals or exceeds five points, and thus has no hope of exceeding the 6½ point total of the first player for the hand. Thus, the first player's total of 6½ points is the winning hand, and the first player collects any wager placed upon the outcome of the hand according to any odds or other rules in effect.

In the event that the dealer draws a three for his/her third card in the above example, thereby acquiring a point total equalling the first player's 6½ point total, the hand is called a "push" or tie, and any wager is returned to the tie player; wagers of tied hands are not awarded to the dealer, as in the game of Twenty One or Blackjack. If the dealer had drawn a four for his/her third card, thus having a total value of 7½ for the hand, the dealer would win the hand. In the event a player acquires a total of 7½, that player cannot lose, but the dealer may equal the 7½ point total during the dealer's play, thus resulting in the hand being a "push," or tie. Play can continue through as many hands as the player(s) may wish to play, with the end game being limited only by the endurance or financial limits of the player(s) in the event of wagering; the game is thus open ended, and a player(s) may join or leave at any time between the play of individual hands of the game.

Other variations are possible with the present game, such as allowing a player to "split pairs." According to this option, a player acquiring first and second cards of equal value (e.g., two threes, twos, aces, or face cards; the rank of the face cards is unimportant, as their value is equal) may elect to use the two equally valued cards to form the basis for two playing hands. The player may continue to do so in the event he/she acquires a third, fourth or subsequent card(s) having a value equal to that of the first card acquired. (It is thus theoretically possible for a player to have a total of twelve split hands per each deck of cards in use in the game, if he/she acquires each of the face cards, e.g., the king queen and jack of spades, hearts, diamonds, and clubs, in each deck of cards, although statistically this is extremely unlikely.) The player must provide a wager equal to that placed for the first hand played, for each of the subsequent split hands, if he/she wishes to take advantage of the split pair option. In some cases, it may be desirable to limit the split pair option to cards having a value of 3 or less (face cards, aces, twos or threes) at the option of the casino or manager of the game. In any case, the dealer is preferably not allowed to split pairs.

Another option which may be used, is that of "doubling down" by a player (again, the dealer is not allowed this option). The rules providing for "doubling down" are relatively restrictive to the player choosing to take advantage of this option. Doubling down may only be done by a player immediately after that player receives his/her first card of the hand; once a player receives a second card, the option is no longer open. Upon receipt of the first card, the player may double his/her wager if he/she wishes to do so. At that time, the player must accept one (and only one) additional card; no further cards will be dealt to a player who is "doubling down." However, a player who has split a pair into two (or further subsequent) hands, is considered to have a series of individual hands containing one card each at the point of the split, and consequently may "double down" each of those hands if he/she wishes. As in the case of split pairs, a permanent dealer in the casino version of the game is prohibited from doubling down.

Yet another option open to players, is that of "surrendering" if a player does not wish to continue the play of a hand after seeing the initial cards dealt during the play of a hand. A player who "surrenders," receives no further cards during the play of that hand and loses one half of his/her bet. However, the player may start anew with the beginning of play of the next hand, if he/she wishes.

It is envisioned that the present game may be played in a casino or gambling establishment environment, and provision is made for such by means of allowing permanent dealers for the "house," the acceptance of bets or wagers and the options dealing with such bets described above, and options relating to the payoff odds for such bets. Normally, an establishment might preferably provide even payment (one unit of payback for each unit bet) to a winning player. However, a casino allowing the play of the present game may wish to provide a better than even payoff for a player who achieves a point total of exactly 7½ with his/her first two cards. Such advantageous payoff is at the option of the establishment setting the rules, but it has been found that a 6 to 5 payoff for a player hitting 7½ on the first two cards is not excessive in view of the odds for the present game.

In view of the specific rules for the present game, a special playing surface 10 has been developed as shown in FIG. 1 and noted further above; the playing surface 10 of FIG. 1 is especially suitable for use with casino games. The embodiment of the playing surface 10 shown in FIG. 1 will be seen to be generally semicircular, with a rounded first or player peripheral portion 12 and a straight second or dealer peripheral portion 14. While the configuration shown in FIG. 1 provides for a dealer and a plurality of players, it will be seen that other playing surface configurations may be used. In order to provide greater comfort for players in a casino environment, the rounded or curved player peripheral portion or rail 12 may include a padded or upholstered surface 16, as shown in FIG. 1.

A plurality of player positions 18 are provided adjacent the curved peripheral rail 12, designating respective areas for the placement of wagers and/or cards (particularly the first card for each hand which is dealt face up). While seven such play positions 18 are shown in FIG. 1, it will be seen that such a playing surface 10 for the present game may provide more or fewer player positions, as desired. Each player position 18 includes an adjacent "surrender" area 20, preferably located toward the inner portion of the semicircular area 10, which surrender areas 20 provide for the surrendering of a hand by a player and one half of the associated bet or wager.

The general player area 22, which contains the player positions 18, is separated from the dealer area 24 by a game rules bar 26 therebetween. Bar 26 serves to separate the dealer area 26 and the general player area 24 from one another, as noted above, and also serves to contain game rules or provisions 28 serving to remind the players of certain conditions, e.g., "Dealer draws to 4½ and stands on 5" as shown. In addition to the above, a dealer position 30 having a plurality of spaces 32 therein is provided for the placement of cards (particularly in the case of multiple decks), wager chips, etc.

In accordance with the above disclosure, a game is provided using a modified card deck or decks in which players attempt to approach or meet an absolute, predetermined limit without exceeding that limit, and additional variations are provided, e.g., "doubling down" and "splitting pairs," for added interest. The present game may be played among two or more players in a private setting, with one of the players serving as a designated dealer or with the dealer alternating among the players. The game may also be played in a casino or gambling establishment using much the same rules, with the establishment providing a permanent dealer for the game. A playing surface (e.g., game board or table top) including features providing specifically for the play of the present game is also disclosed. In the casino environment, it is envisioned that multiple card decks (e.g., six to eight decks) modified by means of removing the tens, nines and eights, would be used in the play of the present game. Moreover, while the above disclosure discusses the manual play of the present game between two or more players, it will be seen that the present game also lends itself to adaptation to play by means of computer or electronic devices, with the provision of the appropriate algorithms, programs and/or software.

It is to be understood that the present invention is not limited to the sole embodiments described above, but encompasses any and all embodiments within the scope of the following claims.

I claim:

1. A method of playing a card game for at least two players, said method comprising the steps of:

providing at least one deck of cards having four suits, wherein each suit includes seven spot cards with point values from one through seven and three court cards with a point value of one half point each;

designating one player as a dealer to deal cards to each of the players;

allowing each player to place a wager;

beginning play of a hand of the game with the dealer providing each of the players and the dealer with a first card with the face of each first card exposed to each of the players, whereby each of the players and the dealer may determine the point value of each first card;

allowing each player a surrender option of surrendering one half of their wager and terminating the play after receiving the first card;

allowing each player a doubling down option of doubling their wager after receipt of the first card, and requiring the player to accept a second card upon selection of the doubling down option by the player, wherein the player cannot receive additional cards;

continuing play of the hand by providing each of the players and the dealer with a second card according to the wishes of each of the players and the dealer, with the face of the second card for each of the players being played face down so that the value of each second card is known only to each of the respective players receiving each respective card;

allowing each player a splitting option of forming an additional playing hand based upon the receipt of subsequent cards having point values equal to the first card received for the game; wherein the point values for the first card and the subsequent card are each less than four; and continuing in the above manner with each of the players attempting to approach a total point value of seven and one half points for each player's respective hand by each player's respective provided cards without exceeding seven and one half points, with any player exceeding seven and one half points being eliminated from play, and declaring a player most closely approaching a total of seven and one half points the winner of the hand of the game.

2. The method of playing a card game according to claim 1, including the further step of:

providing a semicircular playing surface for said game, with the playing surface providing a plurality of player positions in a semicircular array and a dealer position with a separation bar between the dealer position and the plurality of player positions.

3. The method of playing a card game according to claim 1, including the further step of:

placing wagers upon the outcome of each hand, with the dealer acting to distribute the wagers to the winner of each hand.

4. The method of playing a card game according to claim 3, including the further step of:

returning any wager to the player placing the wager when the value of the dealer's hand is equal to the value of the hand of the player placing the wager.

5. The method of playing a card game according to claim 1, including the further step of:

providing a plurality of decks of cards.

6. The method of playing a card game according to claim 5, wherein:

the plurality of decks of cards provided comprises six decks.

7. The method of playing a card game according to claim 5, wherein:

the plurality of decks of cards provided comprises eight decks.

8. The method of playing a card game according to claim 1, including the further step of:

allowing each player in consecutive turn to act as the dealer for each consecutive hand of the game.

9. The method of playing a card game according to claim 1, including the further step of:

requiring the dealer to accept an additional card when the hand of the dealer has a value of less than five points, and prohibiting the dealer from accepting any additional cards when the hand of the dealer has a value greater than four and one half points.

* * * * *